US008499390B2

(12) United States Patent
Danias-Borkin

(10) Patent No.: US 8,499,390 B2
(45) Date of Patent: Aug. 6, 2013

(54) MULTI-PURPOSE WAITER'S TOOL

(76) Inventor: Nicholas Danias-Borkin, Santa Monica, CA (US)

( * ) Notice: Subject to any disclaimer, the term of this patent is extended or adjusted under 35 U.S.C. 154(b) by 338 days.

(21) Appl. No.: 12/892,688

(22) Filed: Sep. 28, 2010

(65) Prior Publication Data

US 2011/0072594 A1 Mar. 31, 2011

Related U.S. Application Data

(60) Provisional application No. 61/246,472, filed on Sep. 28, 2009.

(51) Int. Cl.
*B67B 7/44* (2006.01)
*B25F 1/00* (2006.01)

(52) U.S. Cl.
USPC ..... 7/155; 81/3.09; 7/158

(58) Field of Classification Search
USPC ..... 7/151, 155, 156, 160, 167, 168; 81/3.09, 81/3.45, 3.47, 3.48
See application file for complete search history.

(56) References Cited

U.S. PATENT DOCUMENTS

| | | | | |
|---|---|---|---|---|
| 2,679,740 | A | 6/1954 | Seletzky | |
| 3,257,991 | A | 6/1966 | Mosch | |
| 4,854,856 | A | 8/1989 | Steiger Jr. et al. | |
| 5,829,965 | A | 11/1998 | Rubalcava | |
| D413,499 | S | 9/1999 | Anderson et al. | |
| 6,027,224 | A | 2/2000 | Schnell | |
| 6,142,769 | A | 11/2000 | Walker | |
| 6,289,768 | B1 * | 9/2001 | Anderson et al. | 7/155 |
| D452,037 | S | 12/2001 | Smith | |
| 6,732,611 | B2 * | 5/2004 | Miguel | 81/3.45 |
| 7,036,952 | B2 | 5/2006 | Zirk et al. | |
| 7,125,145 | B2 | 10/2006 | Gardiner et al. | |
| 8,015,642 | B1 * | 9/2011 | Oakley | 7/156 |
| 2004/0016058 | A1 | 1/2004 | Gardiner et al. | |
| 2004/0174700 | A1 | 9/2004 | Zirk et al. | |
| 2006/0262518 | A1 * | 11/2006 | Thuma et al. | 362/119 |
| 2007/0186351 | A1 | 8/2007 | Linn et al. | |
| 2008/0201862 | A1 | 8/2008 | Menard-Flanagan | |
| 2008/0202535 | A1 | 8/2008 | Stokes et al. | |

* cited by examiner

*Primary Examiner* — Hadi Shakeri

(74) *Attorney, Agent, or Firm* — Cislo & Thomas, LLP

(57) ABSTRACT

A multi-purpose tool for waiters that allows a waiter to carry and use as a single instrument for multifarious purposes. The multi-purpose tool comprises a housing to hold a lighter, a blade, a bottle cap opener, a corkscrew, a pen, and an LED light. These tools may be secured to the housing via mount, preferably, a U-mount. The housing may be designed with a tapered end to provide an ergonomic grip when using the multi-purpose tool.

16 Claims, 6 Drawing Sheets

MULTI-PURPOSE WAITER'S TOOL

CROSS-REFERENCE

This patent application claims the benefit of U.S. Provisional Patent Application No. 61/246,472, filed Sep. 28, 2009, which application is incorporated in its entirety here by this reference.

BACKGROUND OF THE INVENTION

1. Technical Field

This invention relates to multi-purpose tools for use by waiters in the restaurant industry.

2. Background Art

Service providers, such as waiters in restaurants, have a multifarious function in providing efficient service to the customers of the restaurant, particularly at high end restaurants that focus on customer service. Besides serving the food, service providers may also open wine bottles, light candles, bring checks and other items a customer may want. In many restaurants, particularly those with a romantic ambience, the lights are dimmed making it difficult to see. Undoubtedly, the customer will seek out a service provider to provide any service to convenience the customer.

The business problem that currently exists is that service providers, for example, at restaurants, often do not have their tools readily available when they need them at the point-of-sale, and are thus forced to hunt, search, find, locate, obtain, and return to the point-of-sale with the acquired artifacts to complete the business transaction.

Therefore, it is important for the service provider to carry around the proper tools that allow the waiter to meet any demands of the customer. Service providers may be carrying around several different tools knowing that each will be needed at some point throughout the day. As such, the current separation of the necessary service provider's tools into distinct items impedes a service provider's ability to provide a fluid, efficient dining experience, as today's service providers are currently forced to locate and obtain the necessary implements if they are not carried by the server in his or her apron. Even in cases where service providers do carry the variety of tools on their person or in their apron, they are forced to search, locate, and obtain each tool individually, losing value serving time to this type of fumbling due to the outdated design of kitchen tools.

Therefore, there is still a need for a restaurant service tools to enhance and streamline the business tasks of services providers, such as servers, bartenders, and professional waiters to allow the service provider to achieve a higher volume of clientele seen/served per shift, a higher quotient of productivity during each shift, and thus a higher number of total sales per shift. This feat is currently impeded by the separation of the tools into distinct items.

Simply combining all the tools needed by the service provider is not the solution because this results in a heavy, cumbersome, multi-purpose tool. The tool must be intelligently designed to accommodate the required tools of a particular service provider, and to combine the tools in a manner that minimizes weight and maximizes utility and ergonomics.

BRIEF SUMMARY OF INVENTION

The present invention is directed to a multi-purpose tool for waiter's that allows a waiter to carry and use as a single instrument. The multi-purpose tool comprises a housing to hold a lighter, a blade, a bottle cap opener, a corkscrew, a pen, and an LED light. The tools are uniquely arranged to minimize weight and maximize utility. The handle is designed to be aesthetically pleasing without destroying the ergonomics of the handle.

DETAILED DESCRIPTION OF THE INVENTION

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Figure 1:
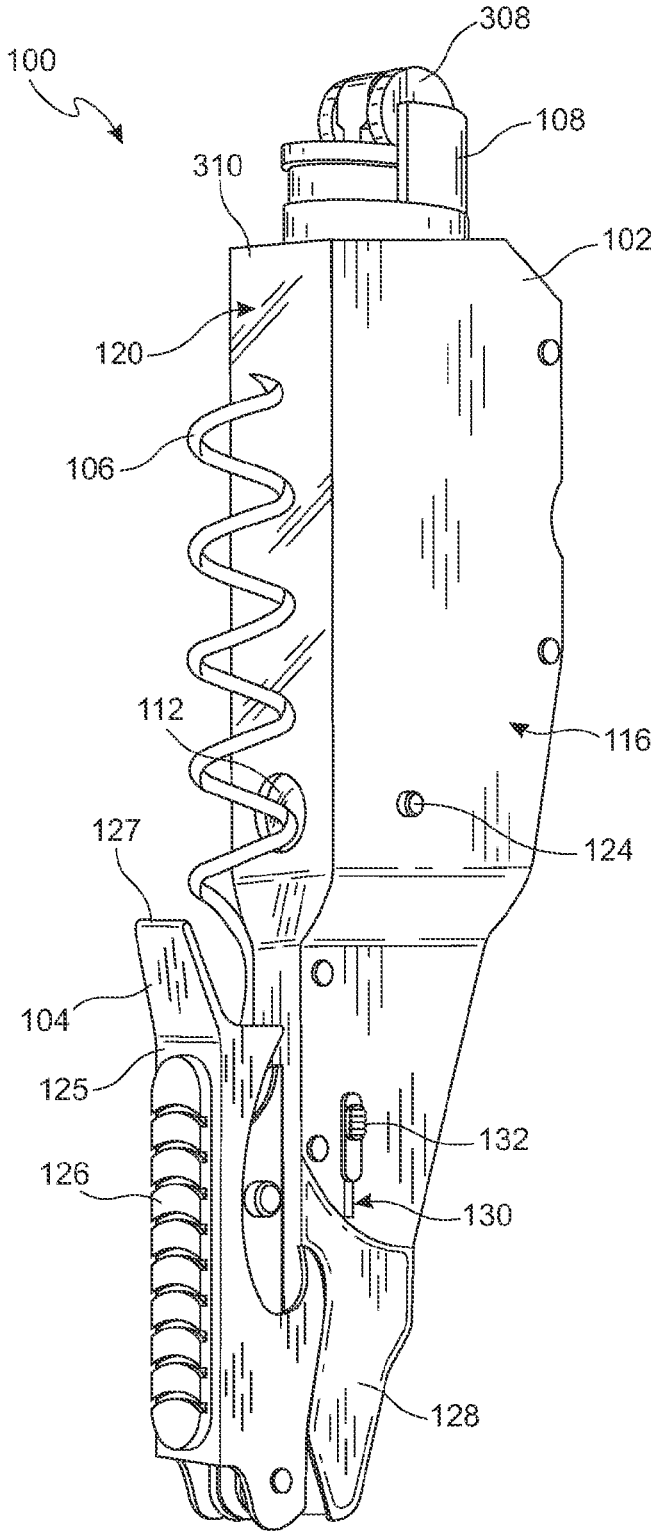
FIG. 1 is a perspective view of an embodiment of the present invention.
Figure 2:
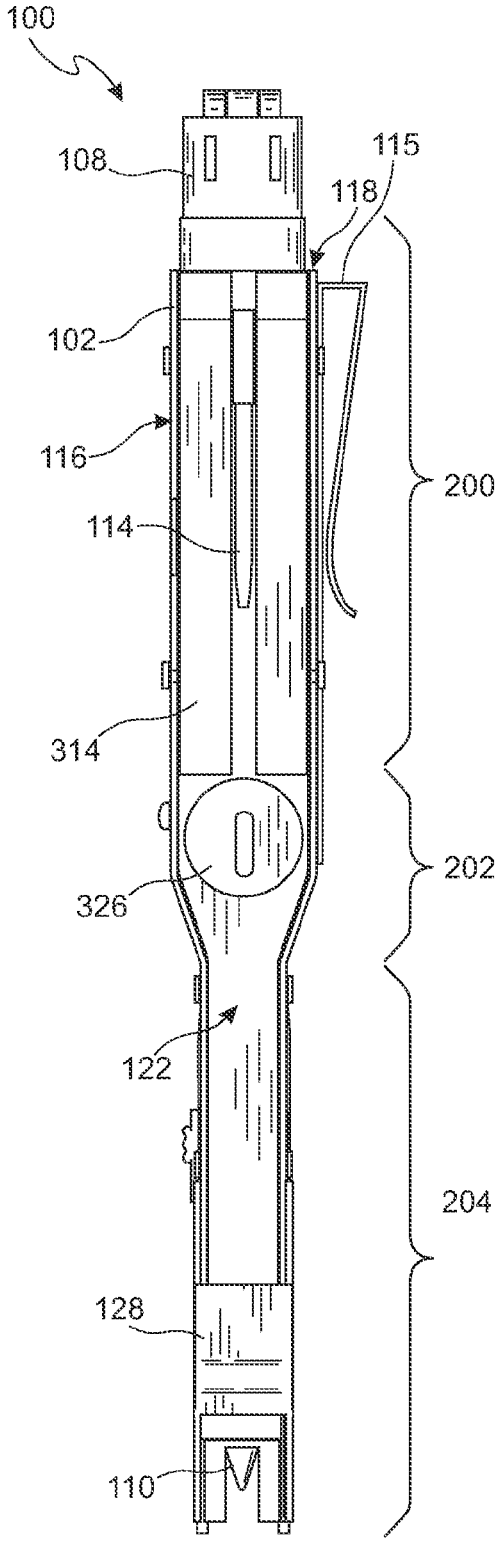
FIG. 2 is a side view of an embodiment of the present invention.

With reference to FIGS. 1 and 2, the multi-purpose tool 100 comprises a housing 102 to contain various tools. A non-exhaustive list of tools includes, but is not limited to, a bottle cap opener 104, a corkscrew 106, a lighter 108, a writing instrument 110, an LED light 112, and a blade 114. In some embodiments, the multi-purpose tool 100 may comprise a belt clip 115.

The housing 102 contains each of the tools in a single location that can be easily carried by the user. The housing 102 may be constructed from a sturdy, lightweight material such as aluminum, preferably brushed aluminum.

The housing 102 generally has four walls, a first wall 116, a second wall 118 opposite the first wall 116, and two side walls 120, 122 opposite each other and adjacent to the first and second walls 116, 118, thereby defining a first portion 200, a midsection 202, and a second portion 204. For the sake of clarity and for ease of reference only, the first and second walls 116, 118 may be referred to as front and back walls, respectively. The four walls further define a compartment 300 to house a lighter 108 and/or some other tool, and an opening 302 to receive the lighter 108 or some other tool. In some embodiments, one of the walls, for example side wall 120 may be highly polished or coated with a refractive material so as to function as a mirror. In some embodiments, face plates 720, 722 may be attached to the outer walls of the tool 100 to hide any internal structures for aesthetic purposes. Alternatively, the face plates 720, 722 may have utility. For example, at least one of the face plates 720 or 722 may be a mirror. The face plates 720, 722 may be attached to the housing in any permanent or reversible manner. For example, the face plates 720, 722 may be attached to the housing by glue, screws, or snap-fit members. Appropriate holes or slits 130*a* may be created in the face plates to accommodate protruding structures.

Figure 3:
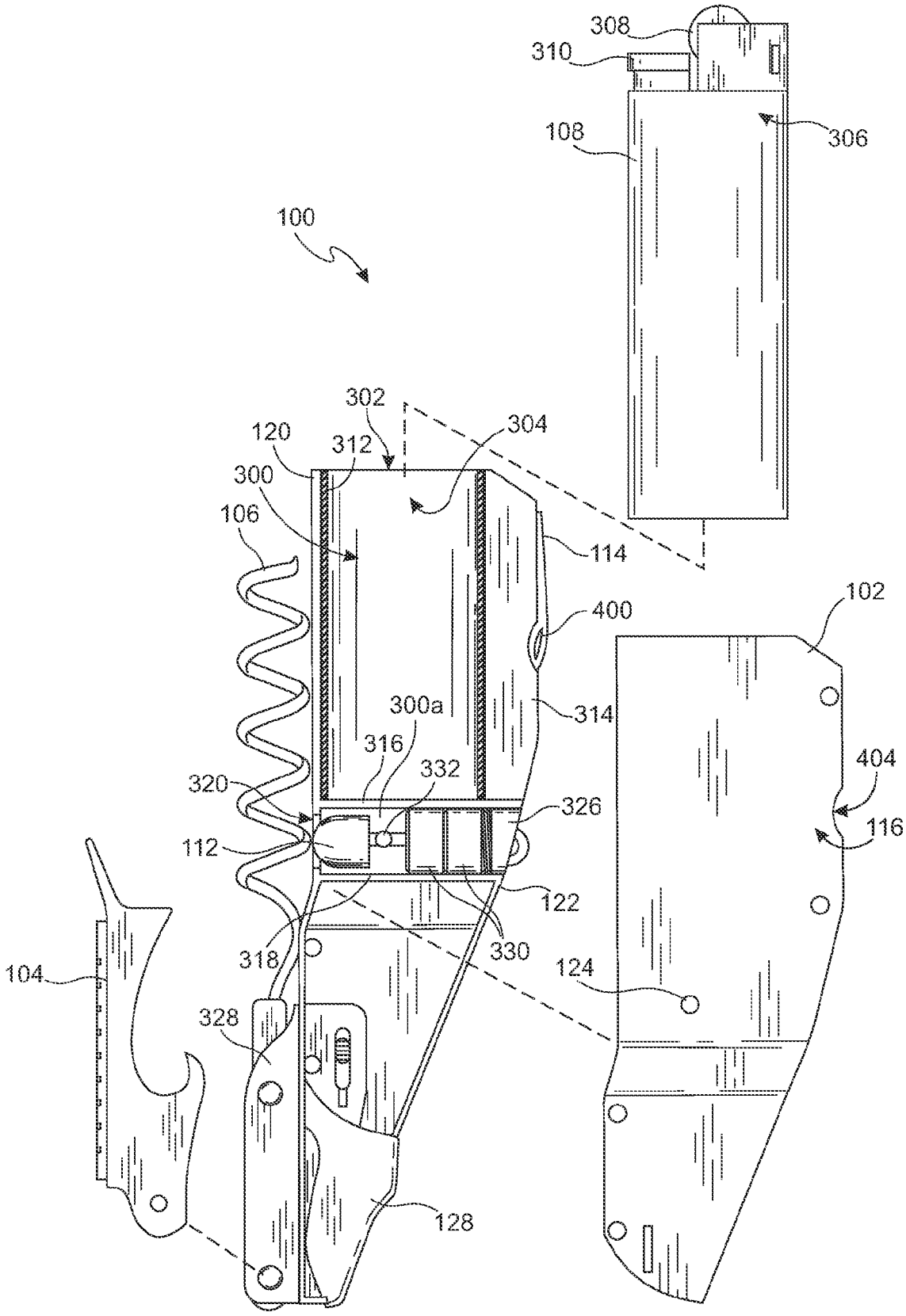
FIG. 3 is an exploded view of an embodiment of the present invention.
Figure 4:
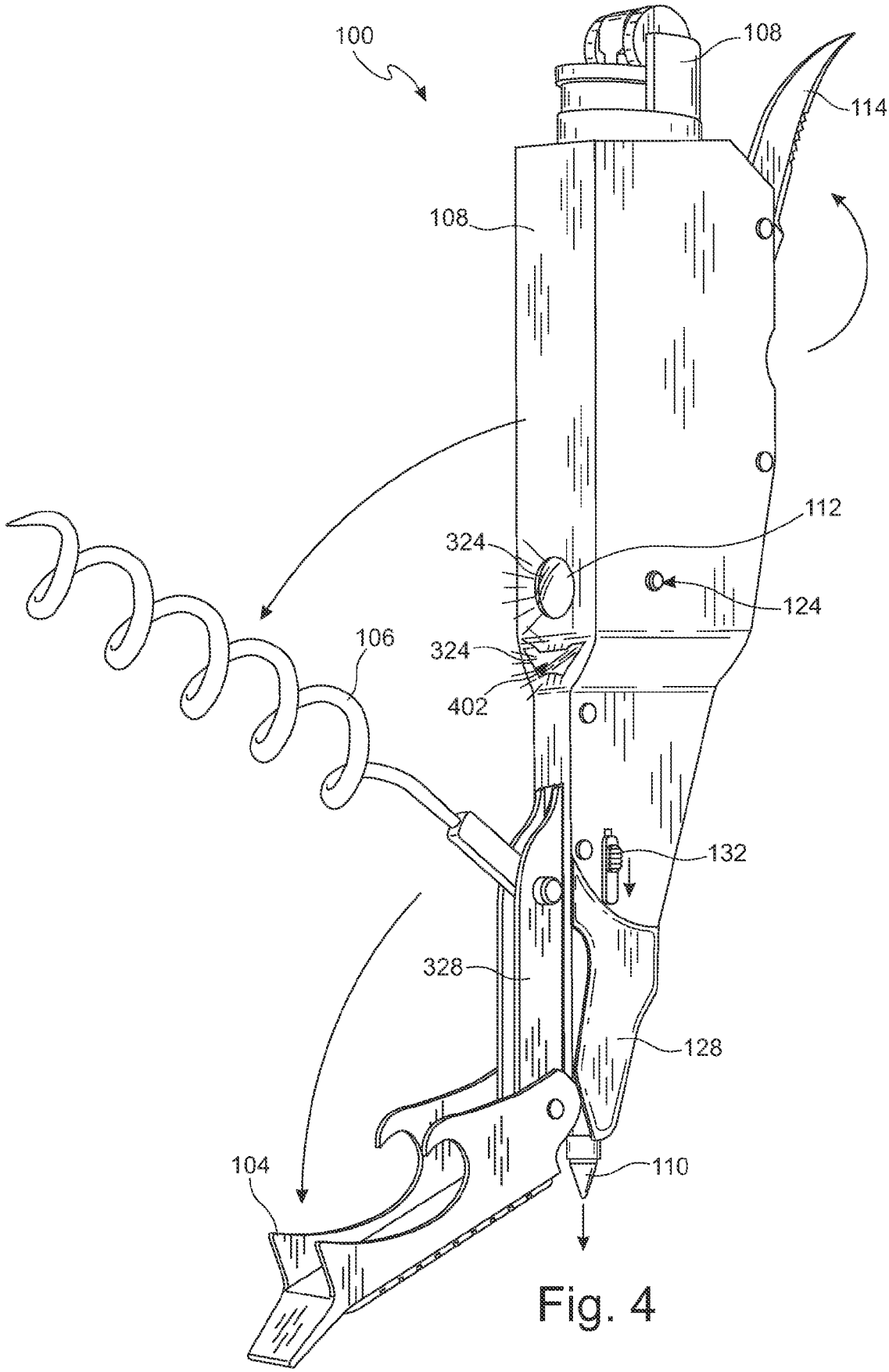
FIG. 4 is a perspective view of an embodiment of the present invention in the open configuration.
Figure 5:
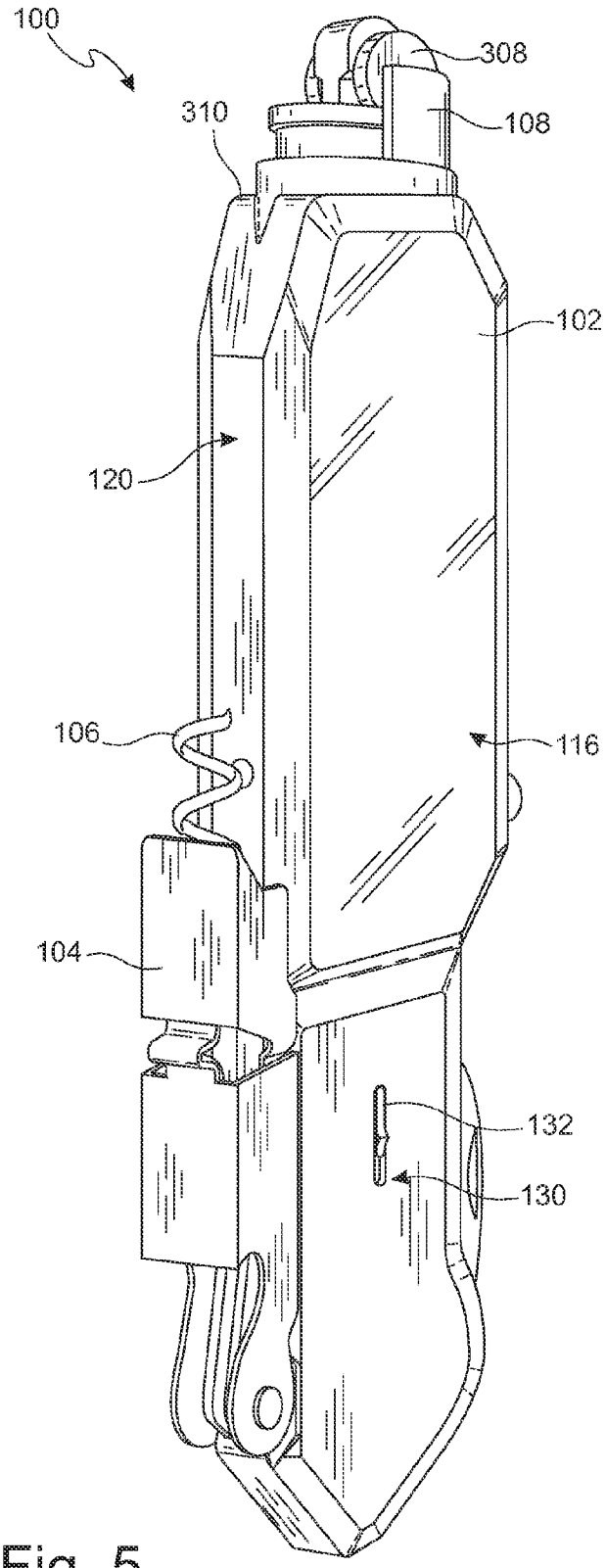
FIG. 5 is a perspective view of an embodiment of the present invention.
Figure 6:
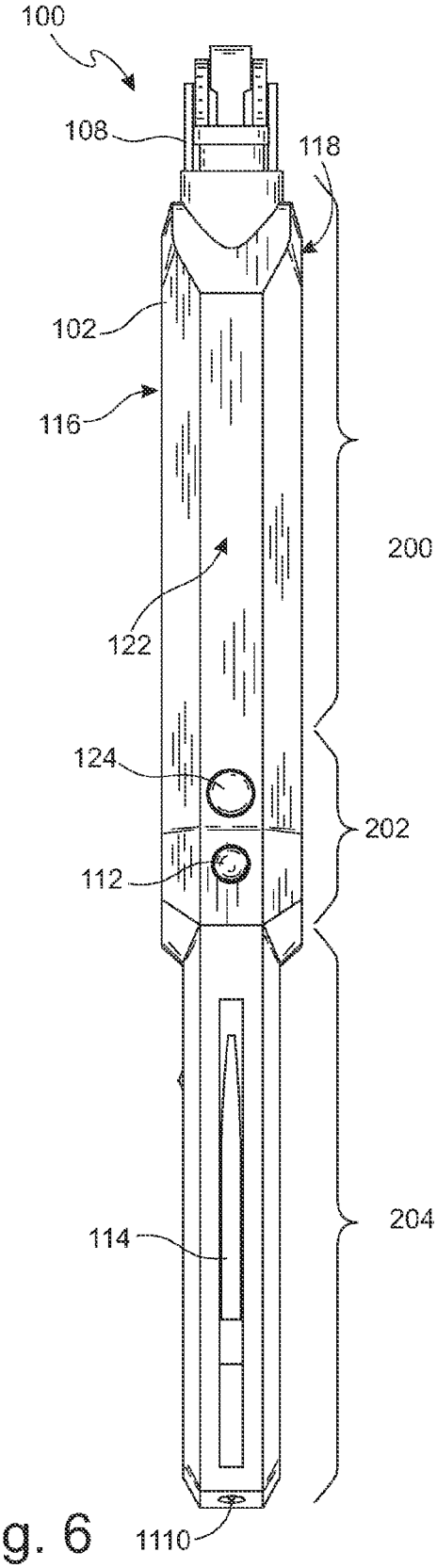
FIG. 6 is a side view of an embodiment of the present invention.
Figure 7:
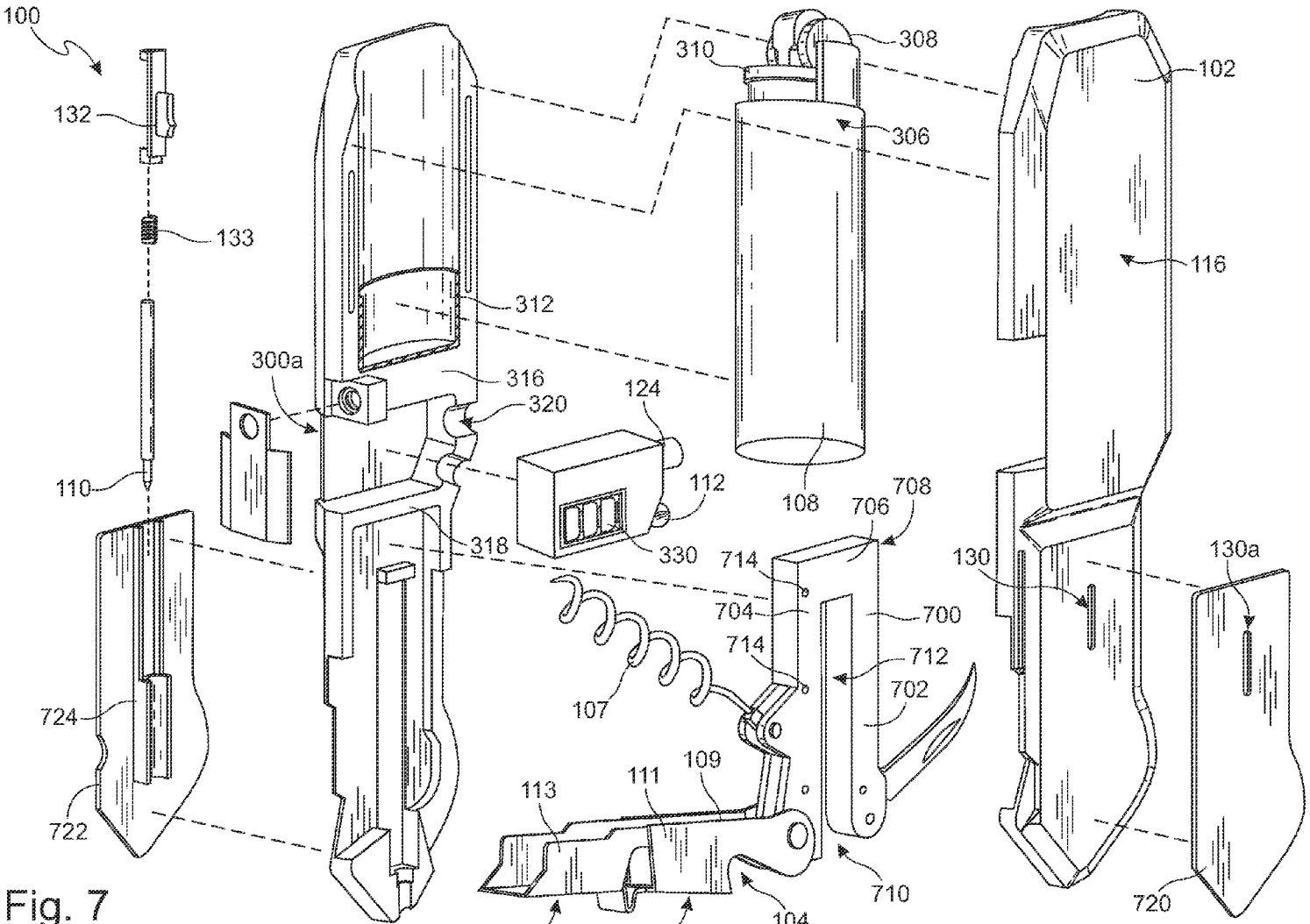
FIG. 7 is an exploded view of an embodiment of the present invention.
Figure 8:
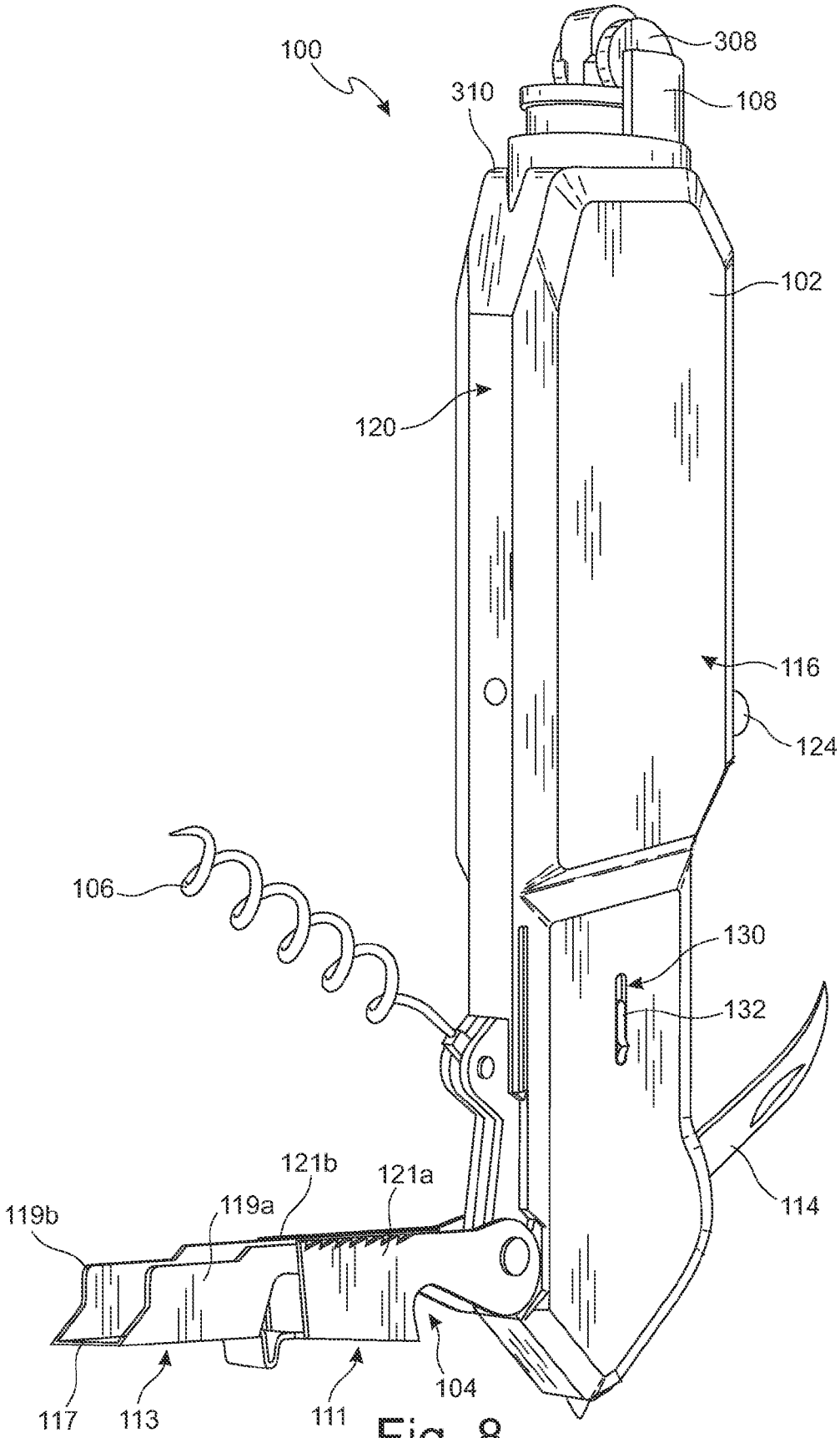
FIG. 8 is a perspective view of an embodiment of the present invention in the open configuration.

In some embodiments, the housing 102 may be generally triangularly shaped when viewed from the front or back. For example, the first portion 200 may be generally rectangular in shape or box-shaped and the second portion 204 may be tapered as shown in FIGS. 1 and 3.

In some embodiments, the second portion 204 may have a parallelogram-like shape with the width of the second portion 204, as defined by the distance from the two side walls 120, 122, being smaller than the width of the first portion 200.

The housing 102 comprises a compartment 300 into which a lighter 108 may be inserted. The lighter 108 may be removable so as to be easily replaced when the fuel is depleted. Thus, when a waiter is asked for a light and the current lighter 108 is depleted, the lighter 108 can be quickly and easily replaced as opposed to refilling the lighter 108 with fuel. The compartment 300 may be sized to accommodate a standard disposable lighter such as those sold under the trademark BIC® or a miniature version of the disposable lighters. In other words, the inner wall 304 of the compartment 300 may be dimensioned to substantially conform to the outer wall 306 of the disposable lighter 108 to create to create some resistance to prevent the lighter 108 from falling out but not precluding removal of the lighter 108. The top of the lighter 108 may protrude from the compartment 300 so that the sparkwheel 308 and the gas release or jet 310 can be accessed while the lighter 108 is still in the compartment 300. This allows the lighter 108 to be used while still in the multi-purpose tool 100 or used after the lighter 108 has been removed from the multi-purpose tool 100.

In some embodiments, the compartment 300 may be lined with an insert 312 to secure the disposable lighter 108, yet allow the lighter 108 to be removable. In some embodiments, the insert 312 may line the entire compartment 300. In some embodiments, the insert 312 may only line a portion of the compartment 300, such as the lower portion so that the lighter 108 smoothly and easily enters the compartment 300 without much resistance until the bottom of the lighter 108 reaches the bottom of the compartment 300.

In some embodiments, the insert 312 may be a permanent coating inside the compartment 300. In some embodiments, however, to accommodate lighters 108 of different sizes, the insert 312 may be removable. In addition, inserts 312 may be constructed with the same outer diameters but with different sized inner diameters to accommodate lighters of different sizes, while still fitting into a standard sized multi-purpose tool 100. Thus, only the inserts 312 need to be replaced to accommodate lighters of different sizes and dimensions. Nonetheless, the multi-purpose tool 100 can also come in a variety of sizes. The insert 312 can be made from material such as plastic, rubber, wood, metal, and the like.

In some embodiments, a blade 114 may be positioned at the first end 200 adjacent to the lighter 108 or at the second end 204 adjacent to the writing instrument 110. The blade 114 may be a standard blade found on pocket knives. In some embodiments, the blade 114 may be serrated. A first mount 314 may be positioned against one of the walls of the compartment at the first end 200, for example, the side wall 122. In some embodiments, the first mount 314 may function as a wall itself. For example, if the blade 114 is positioned on the side, the first mount 314 may function as the side wall 122 and a separate side wall will not be required.

In some embodiments, one of the walls, such as the fourth wall 122 may have a cavity in to which the first mount 314 can be inserted and secured.

The blade 114 may be hingedly attached to the first mount 314 so as to flip or fold in and out from the first mount 314. A groove 400 may be tooled into the non-cutting side of the blade 114 to provide a grip to pull the blade out of the first mount 314. To further accommodate removal of the blade 114, the first and second walls 116, 118 may have notches 404 into which the fingers can be partially inserted to facilitate grasping the blade 114.

In some embodiments, a belt clip 115 may be attached to the first or second wall 116 or 118 of the housing 102 to facilitate carrying the multi-purpose tool 100 outside of a pocket for quick and easy access.

The compartment 300 may further house an LED light 112 and its associated batteries 330 and switch 332. A dividing wall 316 may separate the lighter 108 from the LED light 112, thereby further compartmentalizing the LED 112 and its associated batteries 330 and switch 332. In addition, the dividing wall 316 may serve as a support for the lighter 108. A second dividing wall 318 may be positioned between the light 112 and the second end 204, thereby effectively creating a second compartment 300*a* to further compartmentalize the light 112. A first aperture 320 may be created in one of the housing walls, for example the side wall 120 or 122. The first aperture 320 may be covered with a translucent covering 324 so that an LED light 112 may be positioned up against the translucent covering 324 to allow the LED 112 to shine through the covering 324 and provide light. In some embodiments, the first aperture 320 may not have a translucent covering 324, rather the LED light 112 itself may protrude out through the aperture 320.

A second aperture may be created in the opposite side wall 120 or 122, through which the batteries 330 may be inserted into the second compartment 300*a*. A cap 326 may be used to close the second aperture and contain the battery 328 and LED 112 in the second compartment 300*a*. A button 124 located on the housing 102 may be used to actuate the switch to turn the LED light on and off. In the preferred embodiment, the button 124 is a hard rubber button.

The light 112 may be a standard LED light, although other light sources can be used. The light 112 may come in a variety of colors. The user can select the desired power output of the LED so as to provide sufficient illumination to the surrounding area. In some embodiments, the LED 112 may be pivotally connected to the housing 102 to allow the LED 112 to shine at different angles. This allows the user to adjust the angle of the LED 112 to shine directly on the bottle when the corkscrew 106 or the bottle opener 104 is in use. In some embodiments, the LED 112 may be positioned at a fixed angle. The optimum angle may be determined by the positioning of the corkscrew 106 or the bottle opener 104 so as to provide proper illumination when using these or other tools. The LED 112 should be angled so that when the corkscrew 106 or the bottle opener 104 are used, the LED 112 shines directly at or near the top of the bottle. The LED 112 may also be used to illuminate the surrounding environment to help customers and other employees locate items in the dark.

In some embodiments, a third aperture 402 may be positioned adjacent to the first aperture 320 through which the light may shine. This third aperture 402 may be angled so as to allow the light to shine on the bottle opener or some other tool. The third aperture 402 may also have a translucent covering 324.

In some embodiments, a separate light source may be implemented for the first and second apertures 320 and 402 so that the two lights can be used for a separate purpose. For example, one light source may be used to illuminate the tools to assist use of the tools in the dark. The other light source may have a different power output to illuminate the surrounding areas. The various light sources can be positioned alone or in any combination on any wall on the housing to accomplish the purposes described above. In some embodiments, the light source may illuminate through a slit in the housing.

Designated buttons 124 can be positioned on the housing to actuate any of the lights. In some embodiments, the blade 114 may be operatively connected to a switch to actuate one or more of the light sources.

The second end 204 of the housing 102 is positioned adjacent to the light 112 and may be a continuation of the bottom portion of the first end 200. The second end 204 comprises additional tools. A non-exhaustive list of tools that can be attached to or housed in the second end 204 includes a bottle opener 104, a cork screw 106, and a pen 110. The tools, such as the bottle opener 104, cork screw 106, and blade 114, may be constructed from stainless steel. The bottle opener 104 and cork screw 106 may be hingedly attached to a second mount 328. The second mount 328 can be securely attached to the housing 102. This allows the bottle opener 104 and the cork screw 106 to fold into a closed configuration for storage or an open configuration ready for use.

The top surface 125 of the bottle opener 104 may be lined with a rubber strip 126 to provide comfort to the user when using the bottle opener 104. The tip 127 of the bottle opener 104 may be flattened so as to serve as a screw driver.

As shown in FIGS. 5-8, in some embodiments, the corkscrew 106 may be a double-hinged corkscrew comprising a worm 107 and an arm 109 to provide leverage against the bottle while the cork is being pulled out. In some embodiments, the arm 109 may comprise two levers 111, 113 hingedly connected to each other and the U-mount 700 with one lever mounted on top of the other. Both levers 111, 113 comprise an outer surface 115, 117 and two flanges 119*a*, 119*b*, 121*a*, 121*b* protruding perpendicularly away from the outer surface 115, 117 (towards the housing when in the closed position). The two levers 111, 113 work in conjunction with each other and the cork screw to efficiently remove a cork.

In some embodiments, the first lever 111 may comprise the bottle opener 104 comprising a curved recess into which a bottle cap can be inserted for removal. In some embodiments, at least one of the flanges 119*a*, 119*b*, 121*a*, 121*b* of the levers may be sharp and even serrated so as to function as a knife. The serrated edge and the bottle opener may be on opposite sides.

The second end 204 is ergonomically designed to provide a comfortable grip when using the tools at the second end 204. The side walls 120, 122 at the second end 204 gradually taper toward each other from the top portion to the bottom portion so as to form a triangular shape when viewed from the front as shown in FIG. 3. In some embodiments, at least a portion of the front and back walls 116, 118 may also taper in towards each other resulting in the second end 204 being thinner than the first end 200 as shown in FIG. 2.

In some embodiments, a portion of the bottom tip of the second end 204 may further comprise a grip 128. The combination of the tapering and thinning of the second end 204 and the presence of the rubber grip 128 provide comfort when using any of the tools at the second end 204. For example, a user can withdraw the bottle opener 104 into the open configuration. The user's hand grasps the housing 102 around the first end 200. The user's thumb naturally falls on the back side of the second end 204 on the rubber grip 128 where the user can apply pressure with the thumb while rotating the first end 200 in an upward direction to open a bottle. In another example, using the cork screw 106, the user may hold the multi-purpose tool 100 in the same manner with the thumb placed on the rubber grip 128 while rotating the tool about an axis defined by the cork screw.

In another example, the user may wish to utilize the writing instrument 110. The user can hold the multi-purpose tool 100 with the closed bottle opener 104 or the rubber strip 126 resting in the wedge created by the index finger and the thumb like a pen or pencil. The index finger naturally falls onto the concaved rubber portion of the grip 128 on the back portion of the multi-purpose tool 100, thereby allowing the user to hold the tool comfortably like a standard writing instrument. The user can also hold the multi-purpose tool 100 so that the rubber grip 128 is wedged between the web of the index finger and thumb while the index finger rests on the rubber strip 126.

On one wall of the housing 102, the second end 204 may further comprise an orifice or slot 130 through which the writing instrument retractor 132 protrudes. The writing instrument retractor 132 is operatively connected to the writing instrument 110 so as to expose and retract the writing instrument 110 as necessary. In some embodiments, the writing instrument retractor 132 may lock, thereby allowing the writing instrument 110 to remain in the exposed or open position.

In some embodiments, the writing instrument retractor 132 may not lock, but rather, must be held in order to keep the writing instrument 110 exposed for use. For example, the writing instrument retractor 132 may be spring-loaded 133 so as to maintain a closed or retracted position. In such an embodiment, the writing instrument retractor 132 may be positioned at the second end 204 adjacent to the writing instrument. In particular, the writing instrument retractor 132 may be positioned anywhere along the first or second wall 116, 118 at the second end 204. More preferably, the writing instrument retractor 132 may be positioned so as to be readily accessible by the thumb of a user. This allows the user to quickly and easily expose the writing instrument 110 via the writing instrument retractor 132. Once the user has finished using the writing instrument 110 simply releasing the writing instrument retractor 110 automatically causes the writing instrument 110 to retract, thereby preventing accidental marking. This cannot be done by traditional pens because of the location of the retractor and the fact that pen retractors lock to keep the pen exposed for use.

In some embodiments, a face plate 722 is provided comprising a pen mount 724 onto which the writing instrument 110 can be mounted to slide in and out of the housing.

In some embodiments, to further improve the ergonomic grip and efficiency of manufacturing the tool, the blade 114, bottle opener 104, corkscrew 106, and writing instrument 110 may all be located at the same end, opposite the lighter 108. For example, the lighter 108 may be positioned at the first end of the housing 200, while the bottle opener 104, the corkscrew 106, the writing instrument 110, and the blade 114 are positioned at the second end 204, as shown in FIGS. 5-8.

In the preferred embodiment, the bottle opener 104, the corkscrew 106, and the blade 114 may be secured in the housing by a single structure referred to as a U-mount 700. The U-mount 700, as the name implies is shaped generally like a "U" having a first member 702, a second member 704 and a cross member 706 connecting the first and second members 702, 704. The first and second members 702, 704 are generally parallel, each having a proximal end 708 that is positioned adjacent to the mid-section 202 of the housing 102, and a distal end 710 extending along the second end of the housing 204 away from the mid-section 202. The cross member 706 connects the first and second member 702, 704 at their proximal ends 708. In some embodiments, the cross member 706 may be integrally formed with the first and second members 702, 704. Due to the "U"-shaped design of the U-mount 700, there is a gap 712 in between the first and second members 702, 704. The gap 712 is dimensioned such that when the U-mount 700 is positioned inside the housing 102 at the second end 204, the writing instrument 110 falls within the gap 712. The writing instrument 110 may be spring loaded 133 to remain in the closed position. The writing instrument 110 may or may not have a lock. In the embodiment without a lock, i.e. the lockless retractable pen, the retractor 132 is positioned adjacent to the tip of the pen so as to be readily accessible to a user's thumb to expose the pen when in use and automatically retract the pen once the retractor 132 is released. This further eliminates the time taken to open and then close the pen when complete.

The U-mount 700 comprises a plurality of through-holes 714 so as to secure the U-mount 700 to the housing 102 and secure the blade 114, the corkscrew 106, and the bottle opener 104 to the U-mount 700. In the preferred embodiment, the blade 114 is hingedly mounted on the opposite member 702, 704 with respect to the corkscrew 106 and bottle opener 104.

The U-mount 700 also allows the multi-purpose tool 100 to be customizable. Each tool connected to the U-mount 700 can be removed and replaced with other tools so as to be specifically tailored to the particular needs of the user. For example, some service providers may need a bread crumb sweeper while others do not. This tool can easily be attached to the U-mount 700 to add to the arsenal of tools for the service provider. For example, in embodiments in which the double-hinged corkscrew comprises a knife edge, the blade can be removed and replaced with the crumb sweeper.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention not be limited by this detailed description, but by the claims and the equivalents to the claims appended hereto.

What is claimed is:

1. A multi-purpose tool, comprising:

a. a housing, comprising a first wall, a second wall opposite the first wall, a first sidewall adjacent to the first and second walls, and a second side wall opposite the first side wall and adjacent to the first and second side walls, the housing having a first end, a mid-section, and a second end opposite the first end, the housing defining a first compartment at the first end, a second compartment at the second end, and a third compartment at the mid-section;

b. a removable lighter housed in the first compartment at the first end;

c. a U-mount housed in the second compartment at the second end, wherein the U-mount comprises a first member, a second member parallel to the first member; and a cross member operatively connecting the first member and the second member, wherein the first and second member define a gap in between them;

d. a blade hingedly mounted to the first member;

e. a corkscrew hingedly mounted to the second member;

f. a double-hinged opener comprising a first hinge to hingedly connect a proximal portion to the second member adjacent to the corkscrew, and a second hinge to hingedly connect a distal portion to the proximal portion;

g. a writing instrument positioned in the second end of the housing inside the gap defined by the first and second members of the U-mount;

h. at least one light source housed inside at least one compartment selected from the group consisting of the first compartment, the second compartment, and the third compartment, wherein the at least one light source is positioned to provide lighting to at least one tool selected from the group consisting of the corkscrew, the bottle opener, the blade, and the writing instrument.

2. The multi-purpose tool of claim 1, wherein at least one wall selected from the group consisting of the first wall, the second wall, the first side wall, and the second side wall is a mirror.

3. A multi-purpose tool, comprising:

a. a housing having a first end, a mid-section, and a second end opposite the first end, the housing defining a first compartment at the first end, a second compartment at the second end, and a third compartment at the mid-section;

b. a removable lighter housed in the first compartment at the first end;

c. a U-mount housed in the second compartment at the second end, wherein the U-mount comprises a first member, a second member parallel to the first member; and a cross member operatively connecting the first member and the second member, wherein the first and second member define a gap in between them;

d. a blade hingedly mounted to the first member;

e. a corkscrew hingedly mounted to the second member;

f. an opener hingedly mounted to the second member and adjacent to the corkscrew;

g. a writing instrument positioned in the second end of the housing inside the gap defined by the first and second members of the U-mount;

h. at least one light source housed inside the housing.

4. The multi-purpose tool of claim 3, wherein a first light source is positioned adjacent to and angled towards the corkscrew.

5. The multi-purpose tool of claim 4, further comprising a second light source adjacent to the first light source and configured to emit light perpendicularly away from the housing.

6. The multi-purpose tool of claim 5, further comprising a third light source opposite the first and second light source and adjacent to the blade and configured to illuminate towards the blade.

7. The multi-purpose tool of claim 3, wherein the at least one light source emits light through a slit in the housing.

8. The multi-purpose tool of claim 3, wherein at least one wall of the housing is a mirror.

9. The multi-purpose tool of claim 3, further comprising an insert insertable into the compartment to secure the lighter.

10. The multi-purpose tool of claim 3, wherein the writing instrument is a lockless retractable pen.

11. The multi-purpose tool of claim 3, wherein the corkscrew is a double-hinged corkscrew.

12. The multi-purpose tool of claim 3, wherein the opener comprises a sharp flange to function as a second blade.

13. The multi-purpose tool of claim 12, wherein the sharp flange is serrated.

14. The multi-purpose tool of claim 3, wherein the writing instrument is a retractable pen.

15. The multi-purpose tool of claim 3, wherein a portion of the housing comprises a mirror.

16. The multi-purpose tool of claim 3, further comprising a switch operatively connected to the blade to allow the blade to actuate the at least one light.

* * * * *